US011627815B2

(12) United States Patent
Pittman

(10) Patent No.: US 11,627,815 B2
(45) Date of Patent: Apr. 18, 2023

(54) TEMPORARY SEAT COVER APPARATUS

(71) Applicant: PaperBax, LLC, Statesboro, GA (US)

(72) Inventor: Charanne Rigsby Pittman, Statesboro, GA (US)

(73) Assignee: PAPERBAX, LLC, Statesboro, GA (US)

( * ) Notice: Subject to any disclaimer, the term of this patent is extended or adjusted under 35 U.S.C. 154(b) by 0 days.

(21) Appl. No.: 17/322,327

(22) Filed: May 17, 2021

(65) Prior Publication Data

US 2021/0267383 A1 Sep. 2, 2021

Related U.S. Application Data

(63) Continuation of application No. 15/007,780, filed on Jan. 27, 2016, now Pat. No. 11,013,343.

(60) Provisional application No. 62/120,619, filed on Feb. 25, 2015, provisional application No. 62/108,687, filed on Jan. 28, 2015.

(51) Int. Cl.
*A47C 7/62* (2006.01)
*A47C 31/11* (2006.01)

(52) U.S. Cl.
CPC ..... *A47C 31/11* (2013.01); *A47C 7/62* (2013.01); *A47C 7/622* (2018.08)

(58) Field of Classification Search
CPC ..... A47C 31/11; A47C 7/622; A47C 7/62
See application file for complete search history.

(56) References Cited

U.S. PATENT DOCUMENTS

| | | | | |
|---|---|---|---|---|
| 1,985,222 | A | 12/1934 | Menhall | |
| 3,479,085 | A * | 11/1969 | Weinstein | B60N 2/60 297/228.1 |
| 4,892,353 | A | 1/1990 | Goddard | |
| 5,121,938 | A | 6/1992 | Gross | |
| 6,135,518 | A | 10/2000 | Holthaus | |
| 6,206,468 | B1 | 3/2001 | Brosnan | |
| 6,899,391 | B1 | 5/2005 | Schneller | |
| 7,387,335 | B1 | 6/2008 | Meek et al. | |
| 7,736,057 | B2 | 6/2010 | VanBost | |
| 8,468,779 | B2 | 6/2013 | Kannankeril | |
| 8,720,833 | B2 | 5/2014 | Jack | |
| 8,985,854 | B2 | 3/2015 | Arcot | |
| 9,714,128 | B2 | 7/2017 | Matta | |
| 10,494,163 | B2 | 12/2019 | Hadley | |
| 2002/0074839 | A1 * | 6/2002 | Mahan | A47C 7/425 297/228.1 |

(Continued)

FOREIGN PATENT DOCUMENTS

EP 0457992 11/1991

*Primary Examiner* — Syed A Islam
(74) *Attorney, Agent, or Firm* — Nixon & Vanderhye P.C.

(57) ABSTRACT

A seat back cover in the form of a flexible bag of plastic or paper is shaped to fit over the back of a typical folding chair. The seat back cover may include structure to retain the bag on the chair, e.g., against the force of wind in an outdoor setting. The seat back cover may include vertical adhesive strips with peel covers placed on the back of the bag proximal to the chair edges so that if the cover is put on a smaller chair, the sides of the bag can be folded toward the back of the bag and taped out of the way. Multiple bags may be concatenated on a roll and separated by perforations, and the adhesive strips may be placed so as to fold the corners down over the rounded corners of the chair back.

9 Claims, 11 Drawing Sheets

(56) References Cited

U.S. PATENT DOCUMENTS

| | | | | |
|---|---|---|---|---|
| 2003/0127889 | A1* | 7/2003 | Solomon | A47D 15/006 297/219.12 |
| 2006/0103196 | A1* | 5/2006 | Zaharakos | D03D 11/02 297/228.1 |
| 2009/0119961 | A1 | 5/2009 | Harms | |
| 2009/0284056 | A1* | 11/2009 | Chico | A47C 31/113 297/228.1 |
| 2018/0162597 | A1 | 6/2018 | Jobe | |

* cited by examiner

TEMPORARY SEAT COVER APPARATUS

CROSS-REFERENCES TO RELATED APPLICATIONS

This application is a continuation of U.S. patent application Ser. No. 15/007,780, filed Jan. 27, 2016, pending, which claims the benefit of U.S. Provisional Patent Application No. 62/108,687, filed Jan. 28, 2015, and U.S. Provisional Patent Application No. 62/120,619, filed Feb. 25, 2015, the entire content of each of which is herein incorporated by reference.

STATEMENT REGARDING FEDERALLY SPONSORED RESEARCH OR DEVELOPMENT (NOT APPLICABLE)

BACKGROUND

Field of the Invention

This invention is in the field of chairs, more specifically of coverings for chairs, and still more specifically of coverings for folding chairs. It is also in the field of flexible bags, more specifically flexible decorative coverings that are meant to be put in place when the article being covered is to be used and removed when the article (such as a chair) is taken out of use.

Description of the Related Art

Generally, chair covers are intended to protect the chair from dirt and moisture and are intended for removal prior to use. U.S. Pat. No. 7,387,335 to Meek, et al. describes a cover for a folding chair that keeps dirt and moisture off it prior to use and has a decorative appearance. Other chair covers such as U.S. Pat. No. 4,892,353 to Goddard are meant to stay on the chair and provide both decoration and functional aspects. There is a need for a temporary folding chair cover that decorates the chair when it is unoccupied, is intended to remain in place while someone is sitting in the chair, but is intended to be removed when the chair is not in use. It is also desirable for the cover to be inexpensive and either disposable or reusable.

BRIEF SUMMARY

The invention is a flexible bag of plastic or paper shaped to fit over the back of a typical folding chair, possibly including means to retain the bag on the chair against e.g., the force of wind in an outdoor setting. In an embodiment, the bag includes vertical adhesive strips with peel covers placed on the back of the bag proximal to the chair edges so that if the cover is put on a smaller chair, the sides of the bag can be folded toward the back of the bag and taped out of the way. In another embodiment, multiple bags may be concatenated on a roll and separated by perforations, and the adhesive strips may be placed so as to fold the corners down over the rounded corners of the chair back.

In an exemplary embodiment, a seat back cover includes a first side sized larger than a seat back over which the seat back cover is intended to mount, and a second side connected with the first side and sized larger than the seat back over which the seat back cover is intended to mount. The first side being connected to the second side defines a bag assembly having an open end, a closed end and an interior space. The interior space is sized to fit over the seat back, and the seat back cover is formed of plastic or paper.

The first side and the second side may be rounded at corners of the closed end. The seat back cover may be formed of paper. The seat back cover may be folded into the bag assembly from a flat piece of paper.

The seat back cover may further include a fastener secured to at least one of the first side and the second side and disposed adjacent the open end of the bag assembly. The fastener may selectively secure the first side to the second side adjacent the open end of the bag assembly. The fastener may be a two-piece fastener, with one piece each secured to the first side and the second side, respectively.

The seat back cover may further include a pair of adhesive strips positioned on the second side and covered with a corresponding pair of protective strips, where the adhesive strips are exposed by removing the protective strips. The adhesive strip may be positioned to secure a folded edge portion of the bag assembly to accommodate an alternate seat back that is smaller than the seat back over which the seat back cover is intended to mount. The adhesive strips may be positioned vertically adjacent left and right edges of the second side relative to the alternate seat back.

A pocket may be secured to the second side, and a loop may be secured to the second side spaced from the pocket.

In another exemplary embodiment, a party kit for decorating a plurality of seat backs includes a plurality of seat back covers, where each of the seat back covers includes a first side sized larger than a seat back over which the seat back cover may be intended to mount, and a second side connected with the first side and sized larger than the seat back over which the seat back cover may be intended to mount. The first side being connected to the second side defines a bag assembly having an open end, a closed end and an interior space. The interior space is sized to fit over the seat back, and the seat back cover is formed of plastic or paper. The plurality of seat back covers may be concatenated in a strip. The concatenated seat back covers may be separated from one another by perforations. Each of the seat back covers may include a heat welded bottom at the closed end and heat welded sides.

Each of the seat back covers may further include adhesive strips positioned on the second side and covered with a corresponding pair of protective strips, where adhesive strips are exposed by removing the protective strips. The adhesive strips may be positioned proximate to corners of the closed end.

BRIEF DESCRIPTION OF THE DRAWINGS

These and other aspects and advantages will be described in detail with reference to the accompanying drawings, in which:

FIG. 11 shows an embodiment including a loop in the back for holding flowers, balloons, or the like and/or a pocket in the back for holding a program, a fan, or the like.

DETAILED DESCRIPTION

Figure 1:
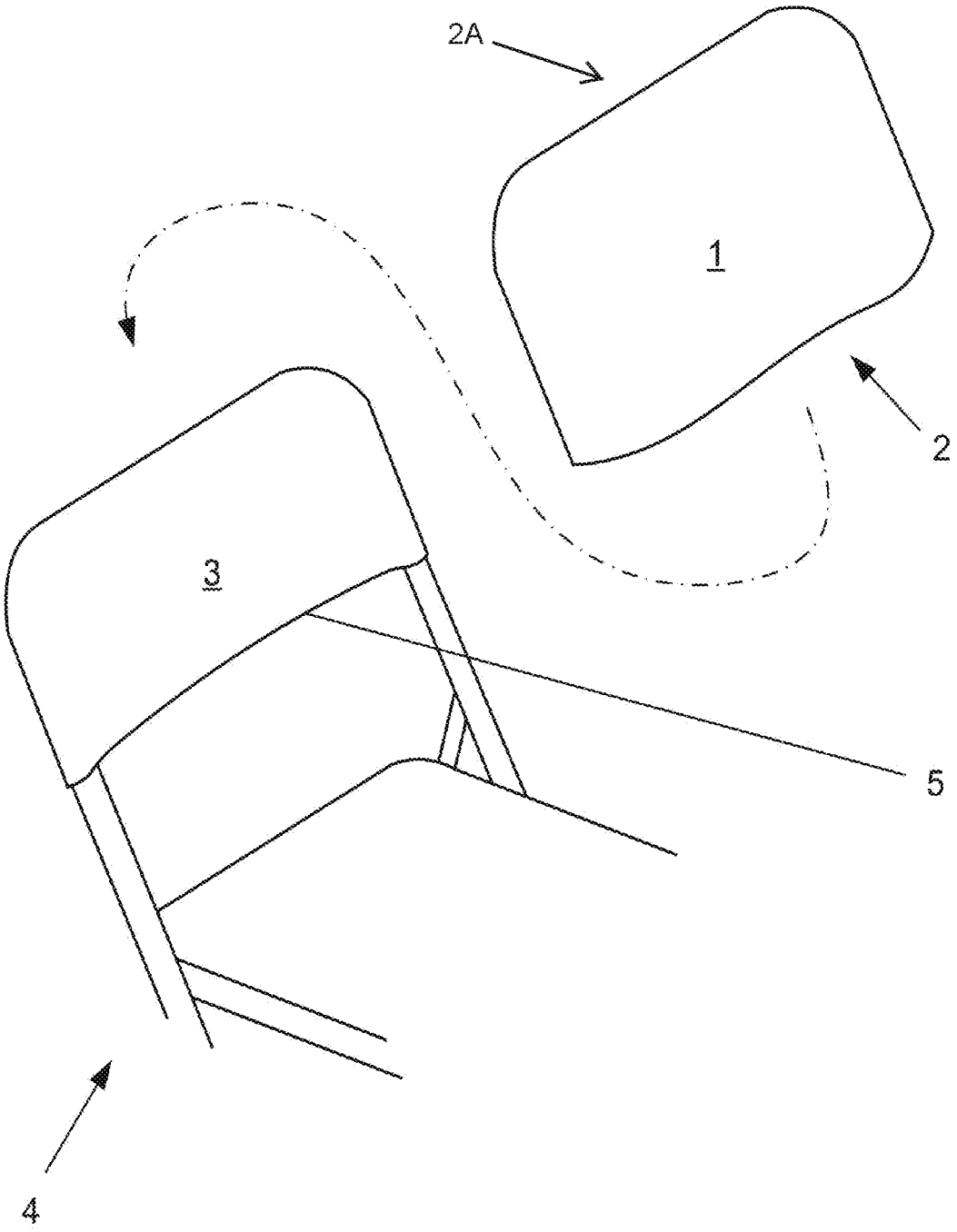
FIG. 1 is a perspective view of a first embodiment.

Referring now to the drawings, which are not to scale, and in which like reference characters refer to like elements among the drawings, FIG. 1 is a perspective view of a first embodiment. A seat cover comprises first side sized larger than a seat back 3 over which the seat back cover is intended to mount and a second side connected with the first side and sized larger than the seat back 3 over which the seat back cover is intended to mount. The first side being connected to the second side defines a bag or bag assembly 1 having an open end 2, a closed end 2A and an interior space. The interior space is sized to fit over the seat back 3, and the seat back cover is formed of plastic or paper. The bag 1 is sized to fit over the seat back 3 of a standard folding chair 4. The seat back 3 of such a chair typically has a substantially horizontal bottom edge 5.

Figure 2:
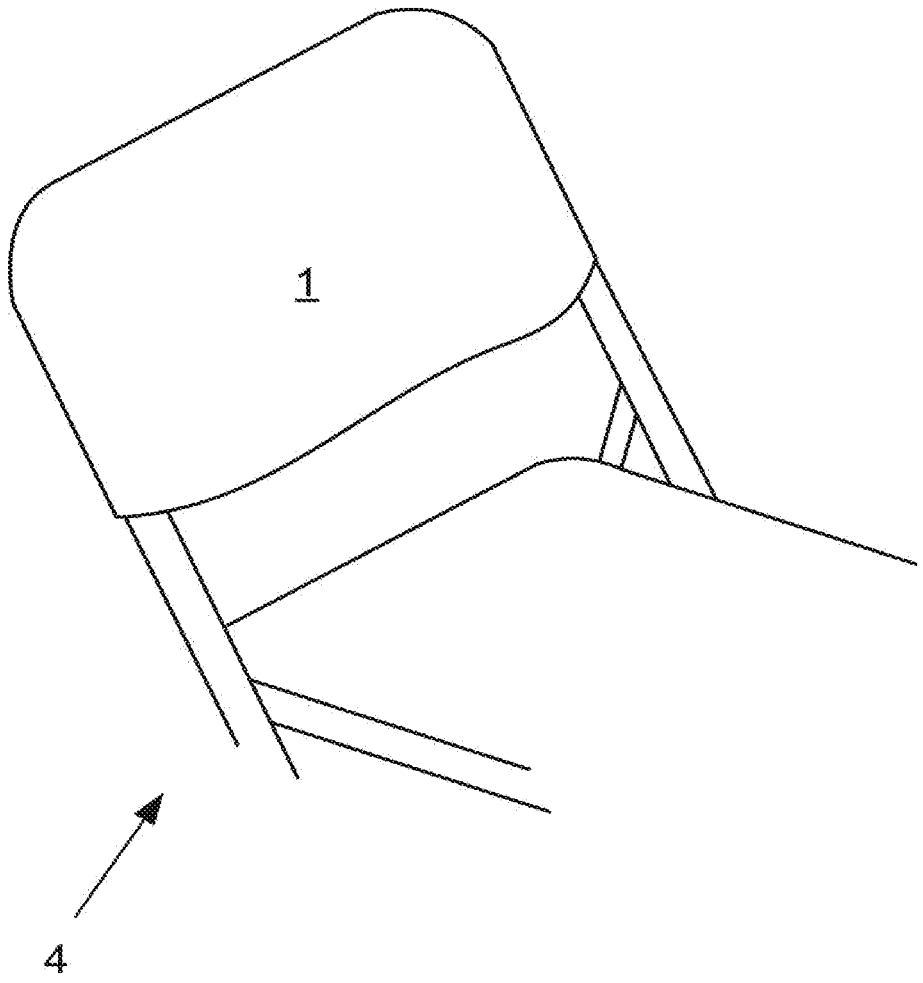
FIG. 2 is another perspective view of the first embodiment.

FIG. 2 is another perspective view of the first embodiment showing the bag 1 fitted on the chair 4.

Figure 3:
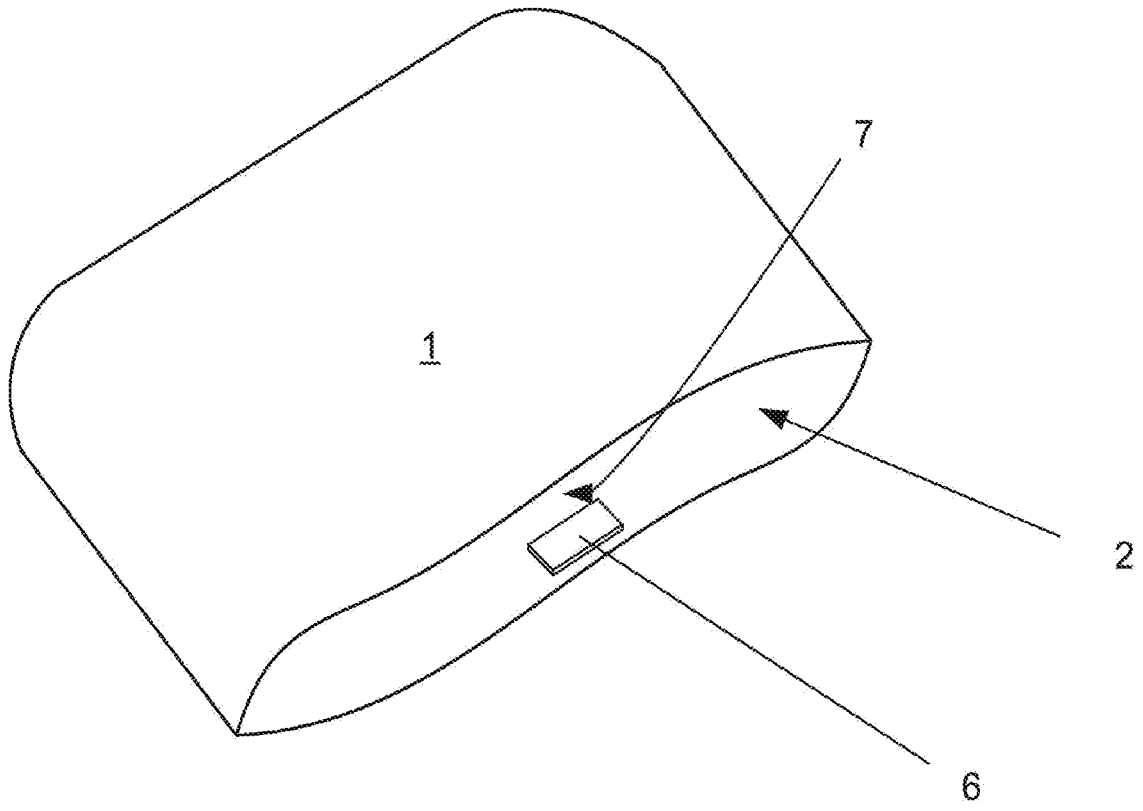
FIG. 3 is a perspective view of a second embodiment.

FIG. 3 is a perspective view of a second embodiment as seen from below. This embodiment adds a fastener 6, 7 near the open end 2 of the bag. One side 6 of the fastener is shown on the lower inner wall of the open end 2 of the bag 1. The complementary side 7 of the fastener is located out of view on the opposite lower inner wall of the open end 2. The fastener depicted may be a rectangular strip of hook-and-loop fastener, although the described embodiments may include other fastener pairs known in the art such as ribbons, snaps and repositionable adhesive patches without exception.

Figure 4:
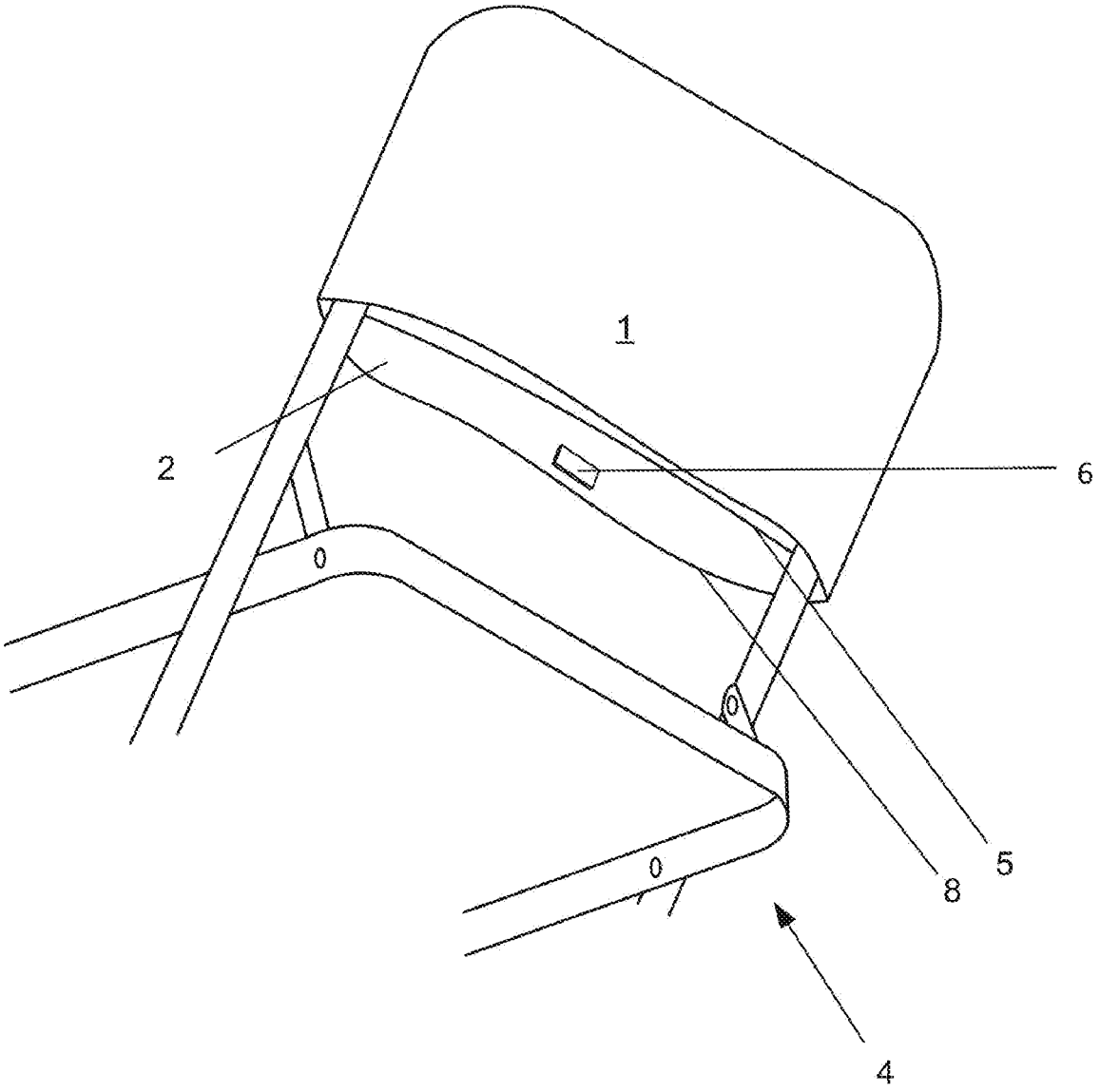
FIG. 4 is another perspective view of the second embodiment.

FIG. 4 is another perspective view of the second embodiment as seen from behind and below the chair 4. The lower edge 8 of the bag 1 is below the bottom edge 5 of the seat back 3 of the chair 4, which permits the one side 6 of the fastener to engage its complementary side on the opposite lower inner wall of the bag.

Figure 5:
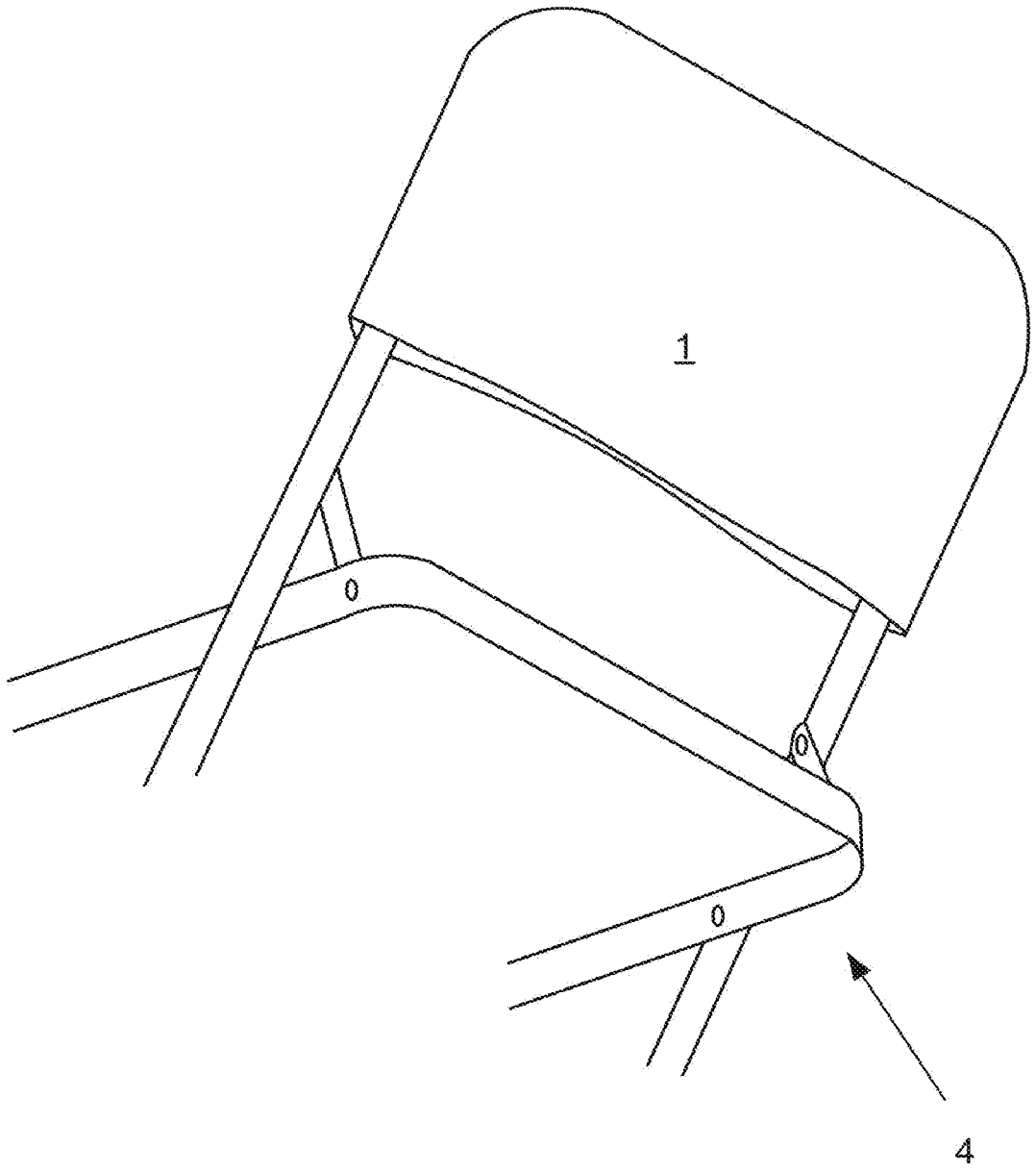
FIG. 5 is another perspective view of the second embodiment.

FIG. 5 is another perspective view of the second embodiment. As shown, the fastener is engaged one side to the other (and is therefore not visible). The bag 1 cannot easily be blown off the chair 4, as might occur outdoors on a windy day.

Figure 6:
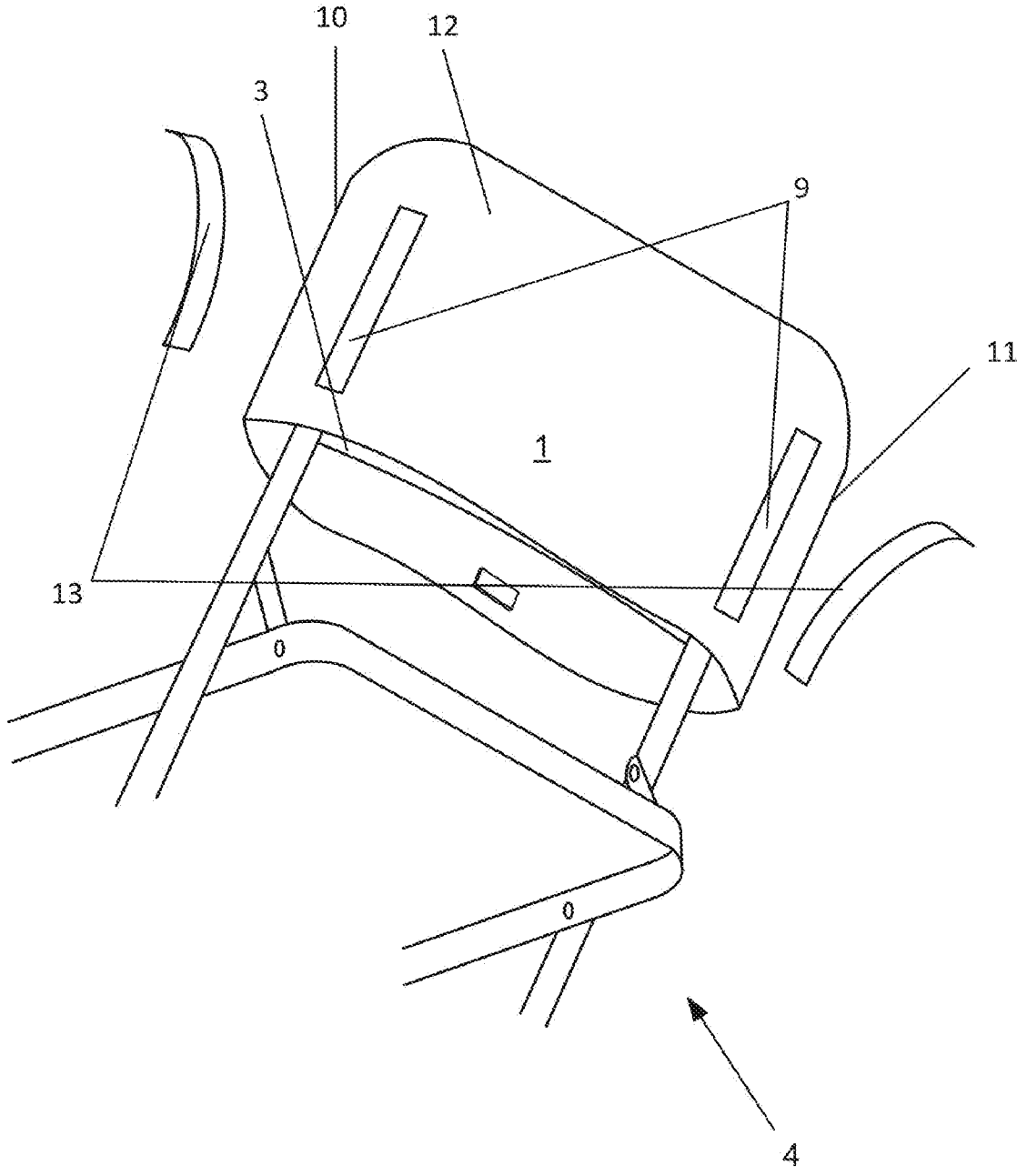
FIG. 6 is a perspective view of a third embodiment.

FIG. 6 is a perspective view of a third embodiment. This embodiment enables the flexible bag 1 of the invention to be fitted more snugly over the seat back 3 of a smaller folding chair 4. In this embodiment, pairs of adhesive strips 9 are positioned proximate to the left and right edges 10, 11 respectively, of the rear face 12 of the bag 1. The adhesive strips 9 are covered by protective strips 13 until it is time to fit the bag to the chair, at which time they are peeled off as shown.

Figure 7:
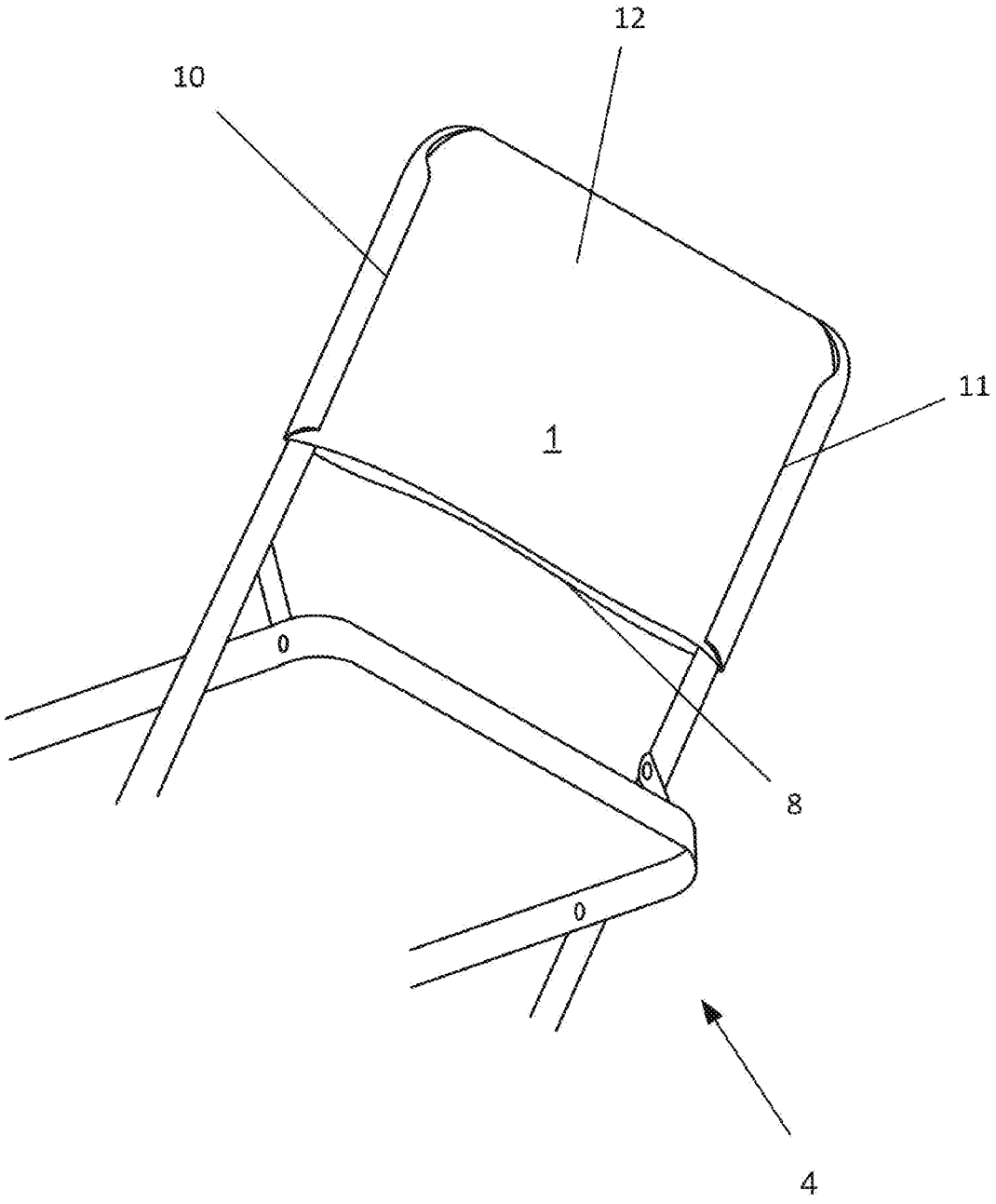
FIG. 7 is another perspective view of the third embodiment.

FIG. 7 is another perspective view of the third embodiment. The left and right edges 10, 11 of the bag 1 have been folded over toward the center of the rear face 12 of the bag 1. The fastener sides 6, 7 (of FIG. 4, not visible in this view) have been engaged near the lower edge 8 of the bag to secure the seat back cover to the chair.

Figure 8:
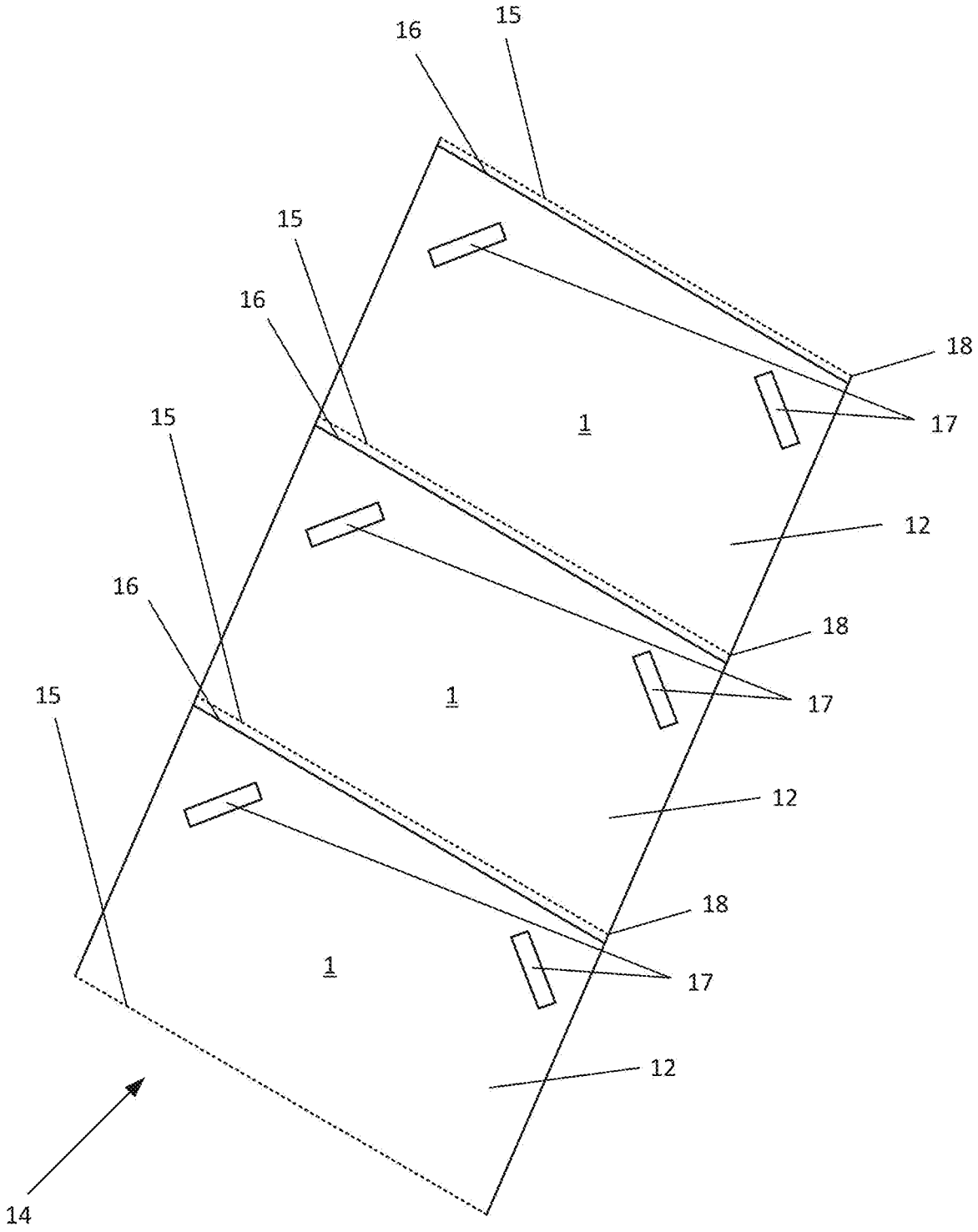
FIG. 8 is a perspective view of a fourth embodiment.

FIG. 8 is a perspective view of a fourth embodiment. In this embodiment, the bag 1 is concatenated into pluralities of itself in a strip 14, each unit separated from the other by perforations 15. The closed top edge 16 of each bag may be formed by heat weld or like technique. Corner adhesive strips 17 are placed proximate to the top corners 18 at approximately a 45° angle to the top edges 16 as shown. The adhesive strips are covered by protective strips as in the third embodiment.

Figure 9:
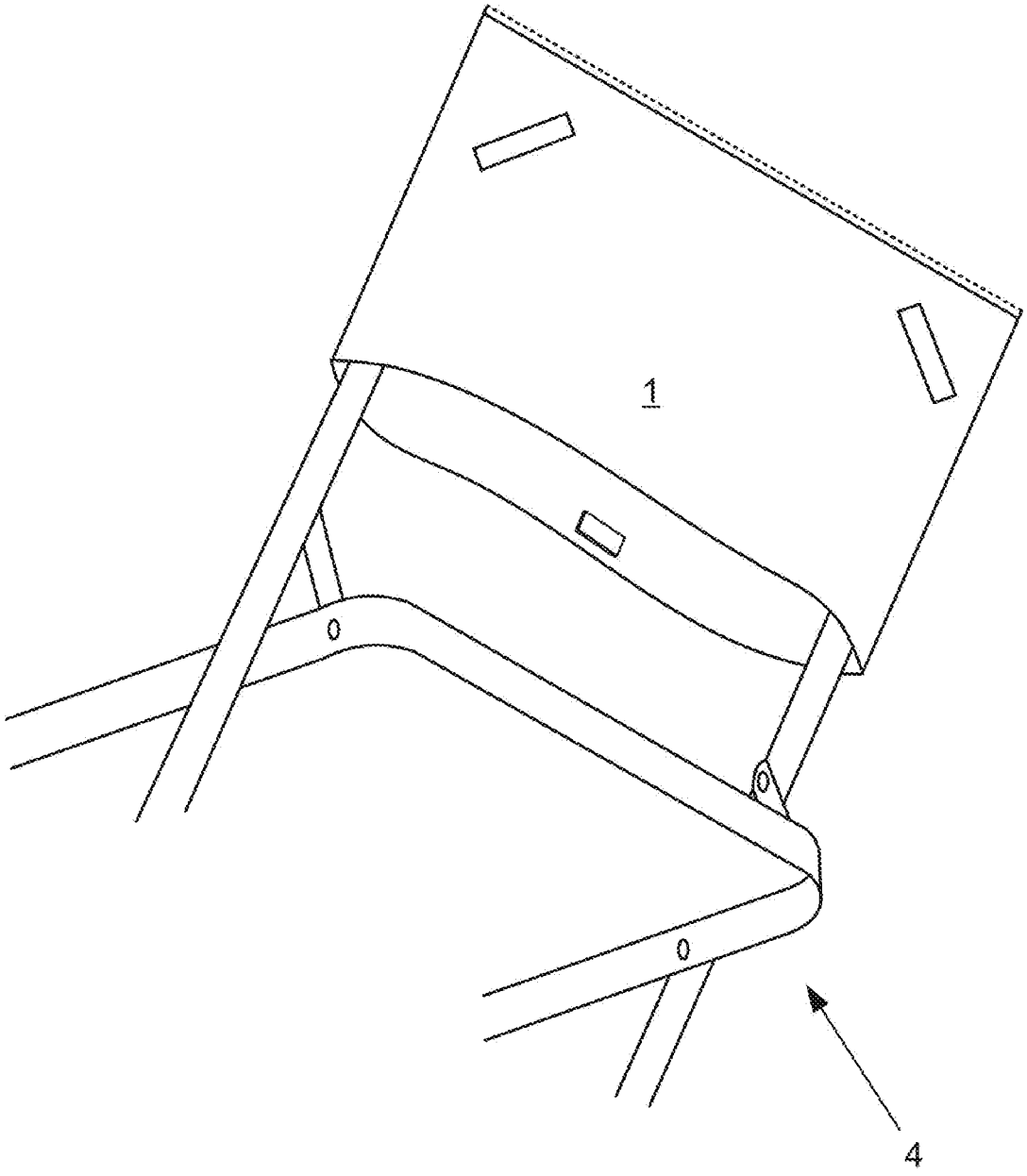
FIG. 9 is another perspective view of the fourth embodiment.

FIG. 9 is another perspective view of the fourth embodiment, in which one of the bags 1 is torn from the strip 14 shown in FIG. 8 and slipped over the seat back of a chair 4.

Figure 10:
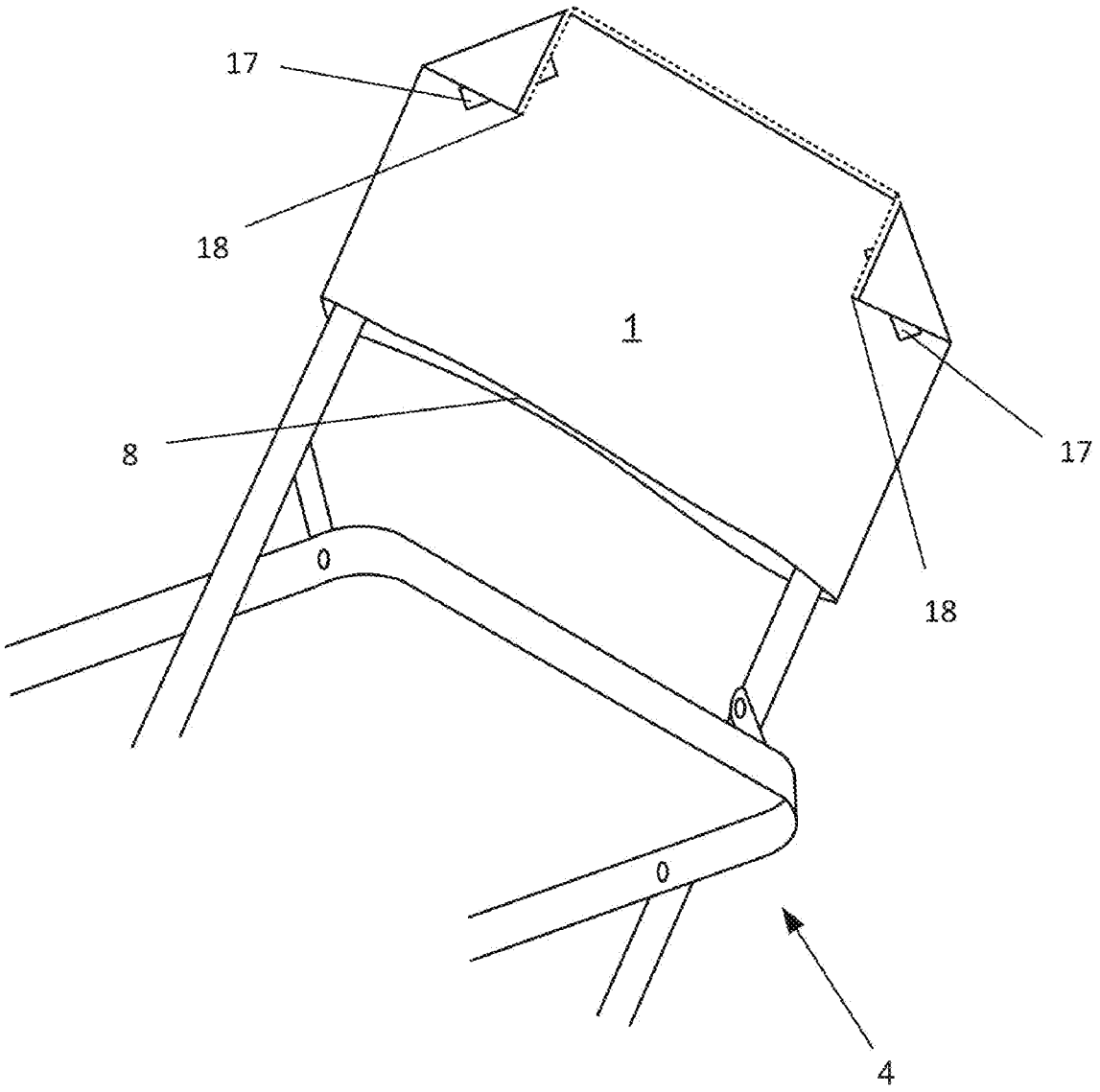
FIG. 10 is another perspective view of the fourth embodiment.

FIG. 10 is another perspective view of the fourth embodiment, wherein the protective strips have been removed from the adhesive strips 17, and the top corners 18 have been folded over toward the center of the rear face 12 of the bag 1 and stuck to the adhesive strips 17. This provides a better fit of the seat back cover to the typically rounded top corners of the chair. Again, the fastener sides 6, 7 (of FIG. 4, not visible in this view) have been engaged near the lower edge 8 of the bag to secure the seat back cover to the chair.

In all of the above-described embodiments, the invention may further comprise printed matter on either side of the bag, for example, but not limited to, ceremonial decorations.

Figure 11:
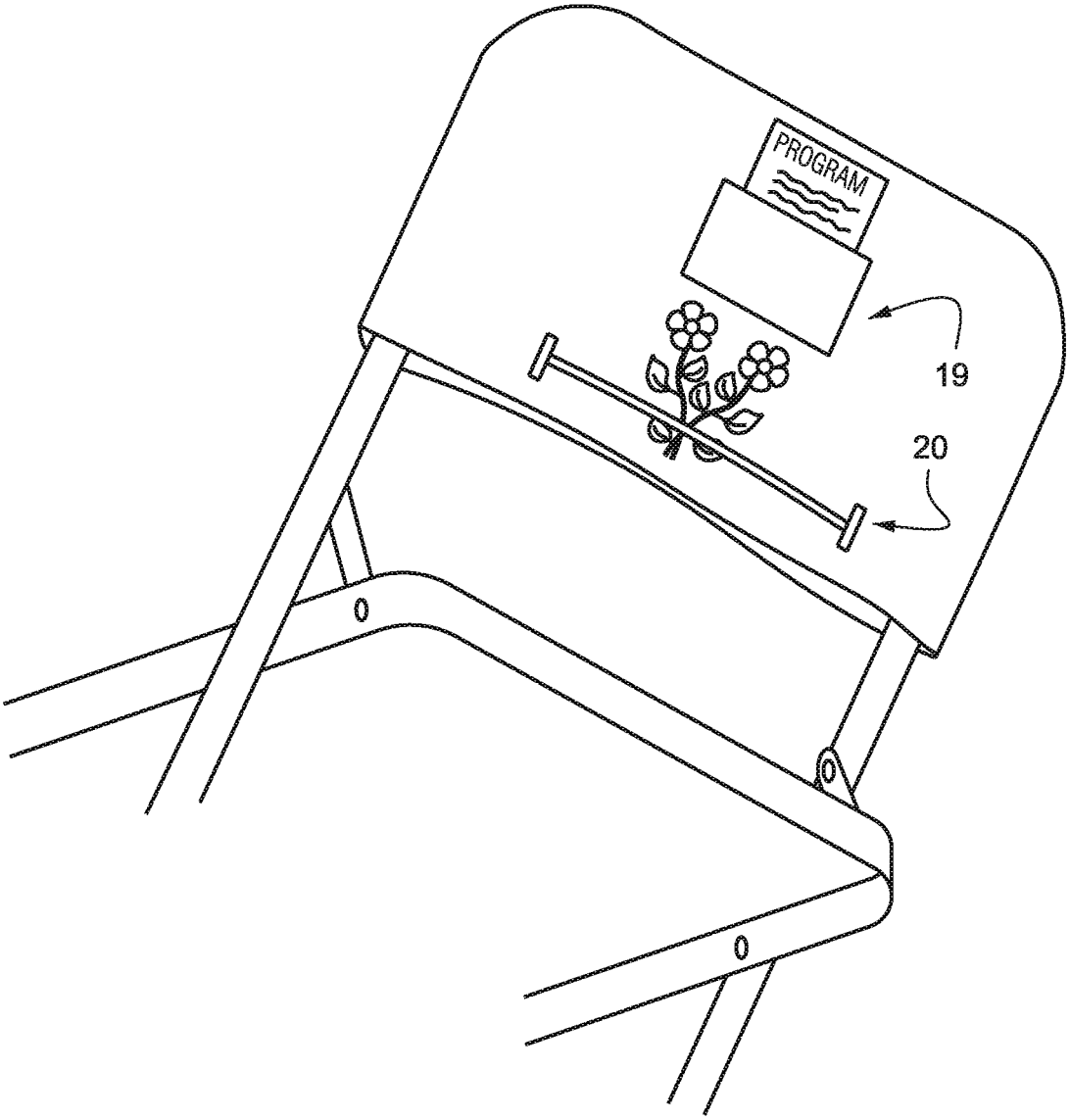

FIG. 11 shows yet other alternatives including a pocket 19 affixed to the middle of the back and used to hold programs, fans, etc., and/or a loop 20 to the middle of the back that could be used to support flowers, tie balloons, or the like. The pocket 19 and/or loops 20 will be attached with adhesive during production. The single piece design can be folded and adhesive applied during production. For example, the seat back covers are be die cut, adhesive is then applied, and the material is folded over and "pressed" to the finished product.

It is evident from the above description that the seat back cover of the described embodiments is highly functional and advantageous and provides a decorative appearance to a simple folding chair while being less expensive to manufacture than existing chair covers and the like.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A seat back cover comprising:

a first side sized larger than a seat back over which the seat back cover is intended to mount;

a second side connected with the first side and sized larger than the seat back over which the seat back cover is intended to mount, wherein the first side being connected to the second side defines a bag assembly having an open end, closed sides, a closed end and an interior space, wherein the interior space is sized to fit over the seat back, and wherein the bag assembly is formed entirely of paper; and a fastener secured to at least one of the first side and the second side and disposed substantially centered in and adjacent the open end of the bag assembly, wherein the fastener selectively secures the first side to the second side adjacent the open end of the bag assembly, and wherein the fastener is the only selective connector between the first side and the second side.

2. A seat back cover according to claim 1, wherein the first side and the second side are rounded at corners of the closed end.

3. A seat back cover according to claim 1, wherein the seat back cover is folded into the bag assembly from material consisting of a flat piece of paper.

4. A seat back cover according to claim 1, wherein the fastener is a two-piece fastener, one piece each secured to the first side and the second side, respectively.

5. A seat back cover according to claim 1, further comprising a pocket secured to the second side.

6. A seat back cover according to claim 5, further comprising a loop secured to the second side spaced from the pocket.

7. A seat back cover according to claim 1, further comprising a loop secured to the second side.

8. A party kit for decorating a plurality of seat backs, the party kit including a plurality of seat back covers, wherein each of the seat back covers comprises:

a first side sized larger than a seat back over which the seat back cover is intended to mount; and a second side connected with the first side and sized larger than the seat back over which the seat back cover is intended to mount, wherein the first side being connected to the second side defines a bag assembly having an open end, closed sides, a closed end and an interior space, wherein the interior space is sized to fit over the seat back, wherein the bag assembly is formed entirely of paper, and wherein each of the seat back covers further comprises at least one of a pocket secured to the second side and a loop secured to the second side, wherein the plurality of seat back covers and respectively defined bag assemblies are concatenated in a strip, and wherein the concatenated bag assemblies are separated from one another by perforations.

9. A party kit according to claim 8, wherein each of the seat back covers comprises a heat welded bottom at the closed end and heat welded sides.

* * * * *